United States Patent [19]

Wakano et al.

[11] Patent Number: 4,464,232

[45] Date of Patent: Aug. 7, 1984

[54] PRODUCTION OF ONE-SIDE ELECTROPLATED STEEL SHEET

[75] Inventors: Shigeru Wakano, Kobe; Akito Sakoda, Nishinomiya; Kunihiro Fukui, Kawanishi; Minoru Nishihara, Kyoto, all of Japan

[73] Assignee: Sumitomo Metal Industries, Lt., Osaka, Japan

[21] Appl. No.: 554,725

[22] Filed: Nov. 23, 1983

[30] Foreign Application Priority Data

Nov. 25, 1982 [JP] Japan ..... 57-207417
Dec. 21, 1982 [JP] Japan ..... 57-225492

[51] Int. Cl.[3] ..... C25D 5/48; C25D 7/06; C25F 5/00

[52] U.S. Cl. ..... 204/28; 204/146; 204/DIG. 7

[58] Field of Search ..... 204/28, 35 R, 146, DIG. 7

[56] References Cited

U.S. PATENT DOCUMENTS 3,178,305 4/1965 Ward ..... 204/146
3,901,771 8/1975 Froman ..... 204/DIG. 7
3,959,099 5/1976 Froman ..... 204/146
3,970,537 7/1976 Froman ..... 204/DIG. 7
3,988,216 10/1976 Austin ..... 204/28
3,989,604 11/1976 Austin ..... 204/DIG. 7

*Primary Examiner*—Thomas Tufariello
*Attorney, Agent, or Firm*—Burns, Doane, Swecker & Mathis

[57] ABSTRACT

A process for producing one-side electroplated steel sheet with the non-electroplating side having a high affinity for chemical conversion treatment is disclosed. The process comprises preparing a one-side electroplated steel sheet by applying a cathodic current thereto in an acidic plating bath simultaneously while slightly electroplating the non-electroplating surface thereof with a coating weight of 0.5 to 5 g/m$^2$ by applying a cathodic current through said non-electroplating surface, and then applying electrolysis to said non-electroplating surface by passing an anodic current through said non-electroplating surface to thoroughly remove said electrodeposition on said non-electroplating surface.

20 Claims, 5 Drawing Figures

PRODUCTION OF ONE-SIDE ELECTROPLATED STEEL SHEET

BACKGROUND OF THE INVENTION

This invention relates to the production of one-side electroplated steel sheet or coil plate (hereunder collectively referred to as steel sheet) with the other side, i.e. non-electroplating side having a high affinity for chemical converting treatment (e.g. phosphating).

The term "one-side electroplated steel sheet" means the steel sheet having one side electroplated and the other opposite side free from electroplating. The other opposite side free from electroplating is hereunder called "non-electroplating side (or surface)" merely for the purpose of distinguishing it from the electroplated side, though even the "non-electroplating side" of steel sheet is slightly electroplated during plating according to this invention.

Recently, one-side electroplated steel sheet has been extensively used as corrosion-resistant material in the automotive industry. In particular one-side electroplated sheet of high strength steel is advantageously used to produce light weight cars with improved mileage economy.

The electroplated steel sheet used for making automobiles etc. is, after being shaped, usually subjected to electropainting, seal-coating and then top-coating, and as a pre-treatment to such painting a chemical conversion treatment such as phosphating is usually carried out so as to improve the adhesion of a paint film to the substrate and its corrosion performance.

As is well known in the art, it is necessary to make the surface to be treated clean so as to promote the formation of nuclei for crystal growth on the surface of the substrate during chemical conversion treatment. However, in the case of electroplated steel sheet since the electroplating is carried out in an acidic bath, the non-electroplating surface of the sheet is gradually corroded by an acid in the plating bath during the one-sided plating, resulting in the formation of corrosion products on the surface of the non-plating side. The thus formed corrosion products prevent the formation of crystal nuclei in the course of the chemical conversion treatment. Therefore, in order to provide the non-plating surface with satisfactory chemical conversion properties, it is necessary either to prevent the formation of the corrosion products during electroplating or to remove the once formed corrosion products prior to the chemical conversion treatment.

In the prior art, in order to cope with such problems as in the above the corrosion products has generally been removed after plating. Namely, since the corrosion products are so firmly adhered to the substrate surface that it is difficult to thoroughly remove them merely by means of washing, either one of the following two methods has been used; one is to mechanically grind the non-electroplating surface as a post-treatment to electroplating so as to remove yellow discolored spots as well as the corrosion products; and the other is to subject the non-electroplating surface to electrolytic pickling in an acidic bath after the electroplating so as to remove the corrosion products from the surface, and then plating a specific metal such as nickel in a very small amount with a uniform distribution thereof throughout the surface, resulting in an improvement in the affinity for surface treatment.

However, according to the surface grinding type method multiple stages of grinding are required to thoroughly remove the corrosion products or foreign materials from the substrate surface. Thus, this method is very expensive. Furthermore, since it is difficult to uniformly remove the corrosion products so long as mechanical grinding is employed, unevenness in grinding is unavoidable, resulting in a considerable variation in phosphate crystal size from place to place in the chemical conversion layer. Therefore, the unevenness in grinding brings about a degradation in the affinity for chemical conversion treatment.

In addition, a substantial amount of scratch flaws remain on the surface of the sheet after grinding, and they adversely affect paint film appearance and corrosion resistance of the finishing coating to an extent depending on the depth and density of such grinding scratches. The formation of yellowish rust comprised of hydroxides is also inevitable due to the presence of water remaining on the surface of the steel sheet when it is washed with water after grinding. The formation of such yellowish rust degradates the affinity for chemical conversion of the resulting steel sheet.

According to another method in which a specific metal is electroplated onto the non-electroplating surface of the sheet, it is necessary to provide the plating line with additional costly means such as a series of radial cells in order to deposit the specific metal onto only the non-electroplating surface, making the process expensive. In addition, the electrolytic pickling and the subsequent plating of such a specific metal are carried out in an acidic bath, and the other side of the sheet on which the finally desired objective electroplated layer has already been provided is gradually dissolved or discoloured during the electrolysis and plating. Such dissolution and discolouration possibly degrade the commercial value of the final electroplated product.

SUMMARY OF THE INVENTION

Figure 1:
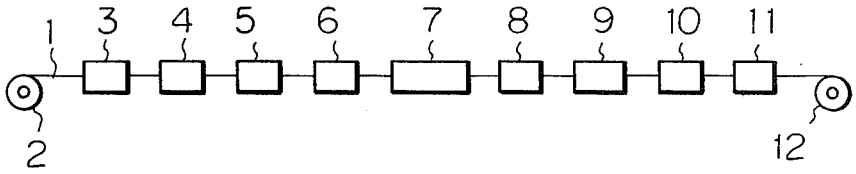
FIG. 1 is an illustration of a production line with which the process of this invention is carried out.

The object of this invention is to provide a process for producing a one-side electroplated steel sheet the non-electroplating side of which has a high affinity for chemical conversion treatment.

The inventors of this invention carried out a series of experiments with the intention of improving the affinity of a non-electroplating surface of a one-side electroplated steel sheet for a chemical conversion treatment such as phosphating, by means of keeping the surface thereof as clean as to prevent corrosion of the surface.

After extensive study based on the results of these experiments, the inventors of this invention found that the application of electroplating even to the non-electroplating surface, by passing a cathodic current through the non-electroplating surface simultaneously with when the one-sided electroplating is being carried out can successfully prevent the corrosion of the non-electroplating surface, though the amount of deposition to the non-electroplating side is very small.

The inventors of this invention also found that the application of anodic dissolution after plating, to the above non-electroplating on which a very small amount of electrodeposition is posited as mentioned above, can advantageously remove the provisional electrodeposition layer from the non-electroplating surface to leave a passivated layer thereon, which can exhibit highly improved affinity for chemical conversion treatment to levels as high as that of conventional cold rolled steel sheet.

Furthermore, inventors of this invention found that not only the non-electroplating side, but also the electroplated side can exhibit improved affinity for a chemical conversion treatment such as phosphating by applying a cathodic current in an amount of 10 $A/dm^2$ or less or by not-applying a cathodic current to the electroplated surface during the application of an anodic current to the non-electroplating surface.

Thus, this invention, in one aspect, resides in a process for producing one-side electroplated steel sheet with the non-electroplating side having a high affinity for chemical conversion treatment, which comprises preparing a one-side electroplated steel sheet by applying a cathodic current to the electroplating side in an acidic plating bath while simultaneously slightly electroplating the non-electroplating surface thereof to provide an electrodeposit layer with a coating weight of 0.5 to 5 $g/m^2$ by applying a cathodic current through said non-electroplating surface, and then applying electrolysis to said non-electroplating surface by passing an anodic current through said non-electroplating surface to thoroughly remove said electrodeposit layer on said non-electroplating surface.

This invention, in another aspect, resides in a process for producing one-side electroplated steel sheet with the non-electroplating side having a high affinity for chemical conversion treatment, which comprises preparing a one-side electroplated steel sheet by applying a cathodic current to the electroplating side in an acidic plating bath while simultaneously slightly electroplating the non-electroplating surface thereof to provide an electrodeposite layer with a coating weight of 0.5 to 5 $g/m^2$ by applying a cathodic current through said non-electroplating surface, then applying electrolysis to said non-electroplating surface by passing an anordic current through said non-electroplating surface to thoroughly remove the electrodeposit layer on said non-electroplating surface, and applying a cathodic current in an amount of 10 $A/dm^2$ or less to the electroplated side during the application of said anodic current to the non-electroplating surface.

Thus, according to this invention, a cathodic current is passed even to the non-electroplating side to effect electrodeposition to a degree slightly enough to not only prevent the dissolution of the substrate but also slight enough so that it can be thoroughly removed during the anodic dissolution following the electroplating. In a preferred embodiment of this invention, the electrodeposits precipitated onto the non-electroplating side during electroplating is in an amount of 0.5 to 5 $g/m^2$, more preferably in an amount of 1 to 3 $g/m^2$.

A current density suitable for achieving such an amount of electrodeposits as in the above may be determined by considering many process factors such as line speed, flow rate of the electrolyte, bath temperature, pH of the bath etc. From a practical viewpoint, the desirable current density may be determined as follows:

Electroplating takes place while the steel sheet is passing between the opposite anodes or is passing near the opposing anode, and corrosion takes place while the steel sheet is passing the area where there is no anode disposed.

Therefore, the coating weight of an electrodeposit layer on the non-electroplating side should preferably be such that the electrodeposits are not dissolved away while passing through the areas where anodes are not disposed in each cell. After determining the minimum requirement of the coating weight, a desirable cathodic current density can be determined. Usually the target coating weight is set a little higher than the above minimum value, though the smaller the better to save energy, in order to avoid the occurence of dissolution of the steel substrate.

In addition, the thus deposited metal layer on the non-electroplating side is removed at the following anodic dissolution stage. Therefore, the smaller the coating weight, the easier to remove the electrodeposits during electrolysis, resulting in less amount of the electric power consumed to remove the deposited layer.

The electroplating bath for use in effecting the electroplating in this invention is not limited to a specific one, and it may be any one conventional in the art.

As mentioned above, according to this invention, following the electroplating mentioned above, the steel sheet is passed to an electrolytic cell where the once-electroplated layer is subjected to anodic dissolution to remove the layer. The electrolytic conditions including the composition of an electrolyte, flow rate thereof, pH, current density etc. may be determined upon consideration of the line speed of the steel sheet. The non-electroplating surface serves as an anode this time.

When the steel sheet is passed into the electrolytic cell, the dissolution of the electroplated layer as well as a vigorous evolution of oxygen gas on the non-electroplating surface occur. Due to these anodic oxidation reactions, the electrodeposits on the non-electroplating side of the steel sheet may be removed, and a passivated layer may be formed on the steel substrate of the non-electroplating side. The presence of such a passivated surface layer can efficiently prevent the formation of rust in the subsequent washing stage. This passivated non-electroplating surface provides a uniform surface layer which can promote a uniform formation of nuclei and crystal growth upon phosphating, exhibiting a high affinity for chemical conversion treatment, e.g. phosphating.

In still another embodiment of this invention, a cathodic current in an amount of 10 $A/dm^2$ or less may be passed to the electroplated surface during the electrolysis. The electroplated surface is opposite to the non-electroplating surface which is now under anodic oxidation. The cathodic current, according to this embodiment, is supplied so as to prevent dissolution of the electroplated layer posited on the surface opposite to the non-electroplating side.

An electrolyte bath suitable for use in the electrolytic oxidation cell comprises the combination of at least one selected from the group consisting of sulfuric acid, carbonic acid and boric acid with at least one selected from the group consisting of sodium hydroxide, potassium hydroxide and ammonium hydroxide. Examples thereof include aqueous solutions of sodium sulfate ($Na_2SO_4$), sodium sulfate ($Na_2SO_4$)+sodium hydroxide (NaOH), sodium carbonate ($Na_2CO_3$), sodium boride ($Na_2B_2O_7$) etc. The concentrations of each of $Na_2SO_4$, $Na_2CO_3$ and $Na_2B_2O_7$ is preferably 5–15%, more preferably 5–10% by weight. Preferably, the electrolyte is comprised of sodium sulfate plus sodium hydroxide or sodium carbonate.

Aluminum ions may be present in the electrolyte.

The temperature of the electrolyte bath is about 35°–50° C., and the pH thereof is preferably 8–12, more preferably 9.5–11.0 in light of its effect on the metal deposition onto the non-electroplating surface.

The anodic current density supplied from the non-electroplating surface to the cathode should be enough to thoroughly remove the provisional electrodeposit layer and to passivate the exposed steel substrate. Such current density may be determined by considering electrolytic conditions including electrolyte composition, pH, line speed etc.

Take the case, for example, in which the electrolyte is comprised of 15% $Na_2SO_4$+NaOH, the pH is 8 and the line speed is 100 m/sec. A desirable anodic current density is about 80 A/dm$^2$. When the electrolyte contains 10% $Na_2CO_3$ and has a pH of 12, the necessary current density may be reduced to 60 A/dm$^2$, since the electrolytic bath contains carbonate ions which exhibit high electrolytic efficiency (the ratio of the total amount of current required to effect passivation to that being supplied).

In this respect, when the electrolyte contains 10% $Na_2SO_4$+10% $Na_2CO_3$ and has a pH of 12, the electrolytic efficiency will be further improved so that a current density at a level as low as 40 A/dm$^2$ is enough to achieve the purpose of this invention.

DETAILED DESCRIPTION OF THE PREFERRED EMBODIMENTS

The process of this invention will be further described with reference to the attached drawings which are presented merely for illustrative purposes and which do not intend to restrict this invention in any way.

FIG. 1 shows one example of arrangements of various processing steps employed in this invention for producing one-side electroplated steel sheet.

As shown therein, a steel sheet 1 is continuously passed from an uncoiler 2, and is then passed through a degreasing cell 3, a washing cell 4, a pickling cell 5, a washing cell 6 and an electroplating cell 7 where the electroplating is applied to only one side of the sheet. According to this invention the non-electroplating side which is opposite to said electroplated surface is also electroplated slightly so as to avoid dissolution of the steel substrate during plating. After the electroplating is finished, the sheet is continuously passed through a washing cell 8 to an electrolytic cell 9 where the non-electroplating surface is subjected to anodic dissolution. The thus treated steel sheet is then passed through a washing cell 10 to a drying chamber 11 and is recoiled by a recoiler 12.

Figure 2:
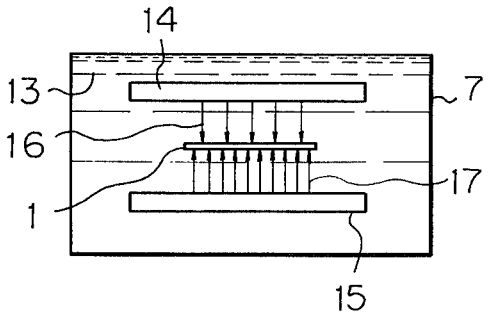
FIG. 2 is a sectional, vertical front view schematically showing the electroplating cell with which the electroplating process in this invention is carried out.

FIG. 12 shows a vertical elevation view in section of said electroplating cell 7 containing an electroplating bath 13. The steel sheet 1 is comprised of the upper surface, i.e. non-electroplating side and the lower surface, i.e. electroplating or electroplated side. According to this invention, as shown in FIG. 2, a cathodic current is supplied to both the upper and lower surfaces while carrying out electroplating by passing the sheet 1 between the opposing anodes 14 and 15 in the electroplating bath 13.

A usual amount of electroplating current is supplied through an anode 15 so as to provide corrosion resistant electroplated coating, as shown by arrow 17. However, an electric current in an amount sufficient to prevent corrosion of the sheet in an electroplating bath is passed through the anode 14 as shown by arrows 16. As is understandable to the person skilled in the art from the above, the provision of an electric circuit including anode 14 and the upper surface of the sheet and of another circuit including anode 15 and the lower surface of the sheet makes it possible to change each cathodic current density independently from each other. After completing the electroplating in the cell 7, the sheet 1 is passed to the electrolytic cell 9.

Figure 3:
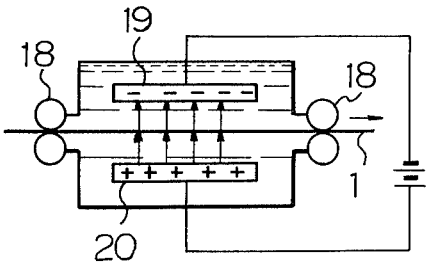
FIGS. 3, 4 and 5 show three different arrangements of electrodes, electric circuits and electric current flows.
Figure 4:
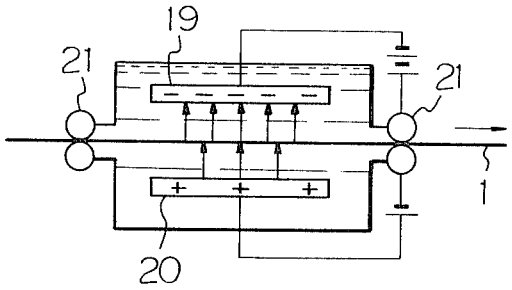
Figure 5:
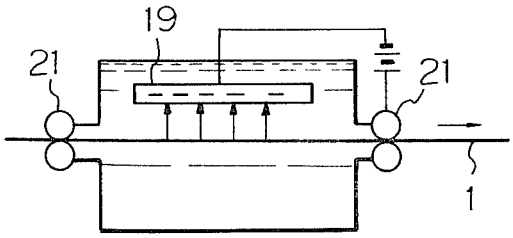

A variety of electrical arrangements of anodes, cathodes, steel sheet etc. for applying an anodic current to the non-electroplating surface in the electrolytic cell 9 are shown in FIGS. 3, 4 and 5, respectively.

FIG. 3 shows one in which the anodic current is supplied through a non-direct contact system, in which steel sheet 1 is passed through the electrolyte between cathode 19 and anode 20. An electric current is passed through the steel sheet from the anode 20 to the cathode 19. Namely, a cathodic current is passed from the anode 20 to the lower surface of the sheet and an anodic current is passed from the upper surface of the sheet to the cathode 19, as shown by arrows.

FIGS. 4 and 5 show cases in which a direct contact system is employed.

In FIG. 4 the steel sheet 1 supported by a pair of conductor rolls 21 is passed between cathode 19 and anode 20. The cathode 19, the upper surface of the steel sheet and conductor roll 21 form an electric circuit which is independent from that comprised of the anode 20, lower surface of the sheet and conductor roll 21. Therefore, in this case it is easy to change the anodic and cathodic currents independently from each other. According to one of the preferred embodiments of this invention, the cathodic current to be supplied to the electroplated surface of the sheet 1 is restricted to 10 A/dm$^2$ or less. The cathodic current is being passed to the electroplated surface while anodic dissolution is carried out with respect to the non-electroplating surface.

FIG. 5 shows a case in which the anode including circuit such as shown in FIG. 4 is excluded. The steel sheet 1 supported by a pair of conductor rolls 21 is passed under the cathode 19, to which an anodic current is passed from the upper surface of the steel sheet 1. No electric current is supplied to the lower surface, i.e. electroplated surface in this case In the case shown in FIG. 3, since there is no need to consider the concentration of leakage currents to the edge portions, the design and arrangement of the edge-masking apparatus may be simplified. However, the potential between electrodes is very high due to a high current density for both the lower and upper surfaces so that electric power cost is very high.

In the cases shown in FIGS. 4 and 5, it is necessary to provide an edge-masking means so as to prevent the edge portions of the electroplating surface from dissolving, though electric power cost is lower than the non-direct contact type method.

For all cases shown in FIGS. 3, 4 and 5, the upper surface constitutes the non-electroplating side and the lower surface constitutes the electroplated side. Need-less to say, the anodic current density supplied from the non-electroplating surface may be adjusted such that the previously electroplated layer may be thoroughly removed by anodic dissolution in the cell 9 for all three cases.

Regarding the cathodic current, the current density is high for the case shown in FIG. 3, low for FIG. 4 and zero for FIG. 5. The current density is schematically shown by arrows in these illustrations.

It is herein to be noted that when the pH of the electrolytic bath is 6 or less, i.e. in an acidic range, the metal contained in the coating is dissolved into the electrolyte bath, and the thus dissolved metallic ions precipitate onto the electroplated surface opposite to the non-electroplating surface. On the other hand, when the pH is higher than 12, i.e. in a strong alkaline range, the electroplated layer posited on the electroplating side is also dissolved. Thus, according to a preferred embodiment of this invention, the pH of the electrolysis bath is adjusted to within the range of 6 to 12, preferably 8 to 12, more preferably 9.5 to 11.0.

In this respect, even if the pH is adjusted within the range mentioned above, a local pH at the boundary area between the electrolyte and the metal surface to be electroplated rises to promote the dissolution of the electroplated coating. The dissolution of the electroplated coating brings about changes in surface conditions, resulting in degradation in its applicability to phosphating.

In order to prevent such dissolution of the electroplated layer, it is desirable to supply a small amount of current to the electroplated surface which serves as a cathode, or not to supply such current at all.

The amount of such cathodic current is limited such that the current should be totally consumed by hydrogen gas evolution at the interface between the electrolyte and the metal surface, and such that it is consumed by the following reaction:

$$Fe^{3+} + e^- = Fe^{2+}$$

Thus, the arrangement shown in FIG. 3 is not applicable when a small amount of cathodic current is supplied to the electroplated coating at the electrolytic stage, i.e. anodic dissolution stage. The arrangement shown in FIG. 4 is preferable. The arrangement shown in FIG. 5 is applicable to a case in which no cathodic current is supplied to the electroplated coating at all.

The following examples are presented as specific illustrations of the claimed invention. It should be understood, however, that the invention is not limited to the specific details set forth in the examples.

EXAMPLE 1

Electroplating was carried out using an actual production line such as shown in FIG. 1 for producing one-side Fe-Zn alloy electroplated steel sheet. The composition of an electroplating bath was adjusted as follows:

$$\frac{[Fe^{2+}]}{[Fe^{2+}] + [Zn^{2+}]} = 0.65$$

pH: 2.0
Bath temperature: 50° C.

A steel sheet (900 mm wide×0.8 mm thick) was continuously passed through the production line shown in FIG. 1 to provide a one-side electrodeposition, the coating weight of which was 35 g/m$^2$.

According to this invention, an electrodeposit layer was also provided on the non-electroplating side with a coating weight of 3 g/m$^2$.

After finishing the electroplating, the steel sheet was continuously supplied at a line speed of 100 m/sec to the anodic dissolution cell 9 in FIG. 1, where the steel sheet was treated under various conditions which are summarized in Table 1 below. No cathodic current was supplied to the electroplated side in this example.

For comparative purposes a one-side electroplated steel sheet with the non-electroplating side not being subjected to electroplating was prepared. This comparative product was not subjected to anodic dissolution, either.

The thus obtained sample sheets were processed by chemical conversion treatment, i.e. phosphating by dipping the sample sheets in a phosphating bath containing the zinc phosphate agent (BT 3030, trade name of Nihon Parkerizing Co., Ltd.) to determine the affinity each of the sample sheets for chemical conversion treatment. The results are summarized in Table 1 below, in which the results of visual examination of the appearance of the samples after electrolysis are also shown.

In Table 1, affinity "0" indicates the cases in which the crystals grow uniformly and finely on the non-electroplating surface of the steel sheet. Affinity "X" indicates the cases in which the crystals formed during phosphating are coarse and are dispersed sparsely.

TABLE 1

| Test No. | Electrolyte composition (% by weight) | pH | Temp. (°C.) | Line speed (m/s) | Current density (A/dm$^2$) | Appearance* | Applicability to phosphating | Remarks |
|---|---|---|---|---|---|---|---|---|
| 1 | 15% $Na_2SO_4$ + NaOH | 8 | 50 | 100 | 80 | O | O | This |
| 2 | 10% $Na_2CO_3$ | 12 | 35 | 100 | 60 | O | O | invention |
| 3 | 10% $Na_2SO_4$ + 10% $Na_2CO_3$ | 12 | 50 | 100 | 40 | O | O | |
| 4 | 5% $Na_2B_2O_7$ | 10 | 50 | 100 | 60 | O | O | |
| 5 | — | — | — | — | — | X | X | Comparative |

Note:
*Appearance "O" indicates a case in which a passivated surface film in fine silver-white was formed.
Appearance "X" indicates a case in which the surface had many small spots which turned black due to overpickling caused by the presence of corrosion products.

As is apparent from the results shown in Table 1, Test No. 5 shows the unsatisfactory applicability to phosphating. This is because electroplating was not applied to the non-electroplating surface during the plating in Test No. 5, resulting in formation of the corrosion products during plating. On the other hand, Test Nos. 1 through 4 which were carried out in accordance with this invention show satifactory applicability to phosphating. This is because the electroplating was applied so as to prevent the dissolution of the steel substrate and the electroplated layer posited on the non-electroplating surface was thoroughly removed during the anodic electrolytic treatment, resulting in a fine and dense passivated film on the non-electroplating surface of the steel substrate.

Test No. 1 shows the case in which a typical electrolyte containing 15% of $Na_2SO_4$ was employed. Test Nos. 2 and 3 show the case, in which the electrolyte contained carbonate ions which have a remarkable effect in promoting electrolysis so as to save electric power consumption. Test No. 4 shows the case in which the electrolyte contained 5% of $Na_2B_2O_7$ so as to reduce the current density required.

EXAMPLE 2

In this example, Example 1 was repeated except that the coating weight of the layer electroplated on the non-electroplating surface was 2 g/m$^2$. The anodic current supplied from the non-electroplating surface to a cathode was 80 A/dm$^2$ for all the cases. A cathodic current was supplied through an anode to the electroplated surface of the steel sheet. The density of the cathodic current was changed from 80 A/dm$^2$ to zero.

The resulting sample sheets were examined with respect to the applicability to phosphating as well as the zinc deposition onto the electroplated surface. The applicability to phosphating was determined in the same manner as in Example 1.

The test results together with the processing conditions are summarized in Table 2.

In Table 2, the "non-contact" current passing system was as shown in FIG. 3 and the "contact" current passing system was that shown in FIG. 4. However, Test No. 15 was carried out using the system shown in FIG. 5.

TABLE 2

| Test No. | Electrolyte composition* | pH | Type of electric connection to the sheet | Current density on the electroplated surface (A/dm$^2$) | Zn deposited on the electroplated surface | Applicability to phosphating** | Remarks |
|---|---|---|---|---|---|---|---|
| 6 | $Na_2SO_4$ | 2 | Non-contact Type | 80 | Yes | X | Comparative |
| 7 | $Na_2SO_4$ | 4 | Contact Type | 60 | Yes | X | |
| 8 | $Na_2SO_4$ | 6 | Non-contact Type | 80 | None | X | |
| 9 | $Na_2SO_4 + Na_2CO_3$ | 10 | | 40 | None | X | |
| 10 | $Na_2SO_4 + Na_2CO_3$ | 13 | Contact Type | 20 | Yes | X | |
| 11 | $Na_2SO_4 + Na_2CO_3$ | 9 | | 20 | None | X | |
| 12 | $Na_2SO_4 + Al_2(SO_4)_3$ | 10 | | 10 | None | O | This invention |
| 13 | $Na_2SO_4 + Al_2(SO_4)_3$ | 7 | Contact Type | 8 | None | O | |
| 14 | $Na_2SO_4 + Al_2(SO_4)_3$ | 9 | | 5 | None | O | |
| 15 | $Na_2SO_4 + Al_2(SO_4)_3$ | 11 | | 0 | None | O | |

Note:
*Each element was contained in an amount of 1 mole.
**The applicability indicated by "X" or "O" is the same as in Table 1.

As is apparent from the test results shown in Table 2, Test Nos. 6 and 7 in which the pH was not higher than 4 show poor applicability to phosphating and Test No. 10 in which the pH was higher than 13 also shows poor applicability to phosphating. This was because the zinc dissolved in an electrolyte was deposited onto the electroplated surface and the phosphating layer obtained become rich in zinc.

In addition, Test Nos. 8, 9, 11, 12, 13, 14 and 15 in each of which the pH was between 6 and 12, i.e., within the range in which zinc does not precipitate onto the electroplated surface during anodic dissolution. In these cases, however, satisfactory applicability were obtained only when the cathodic current density was 10 A/dm$^2$ or less as shown in Test Nos. 12, 13, 14 and 15.

As is apparent from the foregoing, a process for producing one-side electroplated steel sheet according to this invention is the process in which electroplating is also applied to the non-electroplating surface to a slight extent and this electroplated coating is dissolved away during the subsequent anodic dissolution applied to said coating electroplated on said non-electroplating surface. Thus, according to this invention there is provided a clean non-electroplating surface and such a clean surface may advantageously be passivated to provide a non-electroplating surface having a highly improved affinity for phosphating.

Therefore, this invention will make a great contribution to improvement in quality of one-side electroplated steel sheet and to reductions in manufacturing costs thereof.

Although this invention has been described with preferred embodiments it is to be understood that variations and modifications may be employed without departing from the concept of this invention as defined in the following claims.

What is claimed is:

1. A process for producing one-side electroplated steel sheet with the non-electroplating side having a high affinity for chemical conversion treatment, which comprises preparing a one-side electroplated steel sheet by applying a cathodic current to the electroplating side in an acidic plating bath, simultaneously slightly electroplating the non-electroplating surface thereof with a coating weight of 0.5 to 5 g/m$^2$ by applying a cathodic current through said non-electroplating surface, and then applying electrolysis to said non-electroplating surface by passing an anodic current through said non-electroplating surface to thoroughly remove the electrodeposits on said non-electroplating surface.

2. A process as defined in claim 1, in which said electrolysis is carried out in an alkaline electrolysis bath.

3. A process as defined in claim 2, in which the pH of the electrolysis bath is 8 to 12.

4. A process as defined in claim 3, in which the pH is 9.5 to 11.0.

5. A process as defined in claim 1, in which said anodic current is passed from the steel sheet to be treated through a current passing system of the direct contact type.

6. A process as defined in claim 5, in which no current is passed through the electroplated surface while removing the once electroplated layer from the non-electroplating surface.

7. A process as defined in claim 2, in which the electrolysis is carried out using an electrolyte which comprises the combination of at least one selected from the group consisting of sulfuric acid, carbonic acid and boric acid with at least one selected from the group consisting of sodium hydroxide, potassium hydroxide and ammonium hydroxide.

8. A process as defined in claim 7, in which the pH of the electrolysis bath is 8 to 12.

9. A process as defined in claim 7, in which said electrolyte is comprised of sodium sulfate plus sodium hydroxide or sodium carbonate.

10. A process as defined in claim 7, in which aluminium ions are present in said electrolyte.

11. A process for producing one-side electroplated steel sheet with the non-electroplating side having a high affinity for chemical conversion treatment, which comprises preparing a one-side electroplated steel sheet by applying a cathodic current to the electroplating side in an acidic plating bath, simultaneously slightly electroplating the non-electroplating surface thereof with a coating weight of 0.5 to 5 $g/m^2$ by applying a cathodic current through said non-electroplating surface, then applying electrolysis to said non-electroplating surface by passing an anodic current through said non-electroplating surface to thoroughly remove the electrodeposits on said non-electroplating surface, and applying a cathodic current in an amount of 10 $A/dm^2$ or less to said electroplating side during the application of said anodic current to the non-electroplating surface.

12. A process as defined in claim 11, in which said electrolysis is carried out in an alkaline electrolysis bath.

13. A process as defined in claim 12, in which the pH of the electrolysis bath is 8 to 12.

14. A process as defined in claim 13, in which the pH is 9.5 to 11.0.

15. A process as defined in claim 11, in which the anodic current is passed from the steel sheet to be treated through a current passing system of the direct contact type.

16. A process as defined in claim 12, in which the electrolysis is carried out using an electrolyte which comprises the combination of at least one selected from the group consisting of sulfuric acid, carbonic acid and boric acid with at least one selected from the group consisting of sodium hydroxide, potassium hydroxide and ammonium hydroxide.

17. A process as defined in claim 16, in which said electrolyte is comprised of sodium sulfate plus sodium hydroxide or sodium carbonate.

18. A process as defined in claim 16, in which aluminum ions are present in said electrolyte.

19. A process as defined in claim 16, in which the pH of the electrolysis bath is 8 to 12.

20. A process as defined in claim 19, in which the pH of the electrolysis bath is 9.5 to 11.0.

* * * * *